US008858148B2

(12) United States Patent
De Marco et al.

(10) Patent No.: US 8,858,148 B2
(45) Date of Patent: Oct. 14, 2014

(54) BINDING PLANT FOR HARDCOVER BOOKS AND A METHOD OF BINDING FOR THESE BOOKS

(75) Inventors: Giuliano De Marco, Ivrea (IT); Armando Aprato, Ivrea (IT); Francesco Modica, Ivrea (IT); Gianrico Scarton, Ivrea (IT); Francesco Terrusi, Ivrea (IT)

(73) Assignee: Tecnau S.R.L., Ivrea (Torino) (IT)

( * ) Notice: Subject to any disclaimer, the term of this patent is extended or adjusted under 35 U.S.C. 154(b) by 434 days.

(21) Appl. No.: 13/091,183

(22) Filed: Apr. 21, 2011

(65) Prior Publication Data

US 2011/0262248 A1 Oct. 27, 2011

(30) Foreign Application Priority Data

Apr. 22, 2010 (IT) ..... TO2010A0343

(51) Int. Cl.

| | |
|---|---|
| ***B42C 9/00*** | (2006.01) |
| ***B42C 7/00*** | (2006.01) |
| ***B42C 11/00*** | (2006.01) |
| ***B42B 5/00*** | (2006.01) |
| ***B42D 1/00*** | (2006.01) |
| ***B42D 3/00*** | (2006.01) |
| ***B42D 15/00*** | (2006.01) |
| ***B42C 11/04*** | (2006.01) |
| ***B42C 9/02*** | (2006.01) |

(52) U.S. Cl.

CPC ..... *B42C 11/04* (2013.01); *B42C 11/045* (2013.01); *B42C 9/02* (2013.01)

USPC ..... 412/9; 281/3.1; 281/15.1; 281/29; 283/63.1; 283/64; 412/16; 412/17; 412/18; 412/33

(58) Field of Classification Search

USPC ..... 281/3.1, 15.1, 29; 283/63.1, 64; 412/9, 412/16, 17, 18, 33

See application file for complete search history.

(56) References Cited

U.S. PATENT DOCUMENTS

| | | | | |
|---|---|---|---|---|
| 2005/0180843 | A1 * | 8/2005 | Porat | 412/19 |
| 2006/0028662 | A1 | 2/2006 | Dobrovolsky | |
| 2008/0031706 | A1 * | 2/2008 | Silberbauer | 412/19 |

FOREIGN PATENT DOCUMENTS

| | | |
|---|---|---|
| CA | 1 191 520 | 8/1985 |
| EP | 0 477 556 | 4/1992 |
| EP | 0 478 849 | 4/1992 |
| WO | 2007-128536 | 11/2007 |

OTHER PUBLICATIONS

Search Report issued by the EPO in connection with Italian Patent Application No. TO2010A000343 dated Dec. 15, 2010.

* cited by examiner

*Primary Examiner* — Shelley Self
*Assistant Examiner* — Justin V Lewis
(74) *Attorney, Agent, or Firm* — Banner & Witcoff, Ltd.

(57) ABSTRACT

Binding equipment and false cover forming equipment for hardcover books are disclosed. The false cover forming equipment carries out false covers, by positioning a pair of endpapers in correspondence of lateral binding flaps of a respective backstrip, arranging folds of the endpapers at a pre-assembling distance associated with the thickness of the text block and gluing margins of past-down sheets of the endpapers with binding edges of the backstrip. The binding equipment is feedable, at a cover input "IC", with the false covers for carrying out book blocks by gluing the backstrips of the false covers with the binding edges of corresponding text blocks and refolding the pairs of endpapers on the respective text blocks. An electronic processing unit is settable for the control of the false cover forming equipment and the binding equipment as a function of the dimensions of the hardcover book to be bound.

14 Claims, 6 Drawing Sheets

BINDING PLANT FOR HARDCOVER BOOKS AND A METHOD OF BINDING FOR THESE BOOKS

CROSS REFERENCE TO RELATED APPLICATIONS

This application claims priority to Italian Application No. TO2010A000343, filed Apr. 22, 2010, and entitled "Binding Plant for Hardcover Books and A Method of Binding for These Books," the content of which is incorporated herein by reference in its entirety.

FIELD OF THE INVENTION

The present invention relates to a binding plant for hardcover books and a method of binding for these books.

Specifically, the invention relates to a binding plant for hardcover books in which each book is of the type including a hard cover with a pairs of cover boards and a book block with a text block of a given thickness, a backstrip (muslin) with a central portion and lateral flaps and a pair of endpapers with a free sheet, a paste down sheet and a respective fold.

BACKGROUND OF THE INVENTION

A hardcover book is intended as a brochure or a threaded book, formed with a book block and a non-foldable cover. The cover comprises two cover boards and a spine in cardboard coupled to a covering paper, generally plasticized, of cloth or other flexible material. The back of the cover boards is glued at the lateral flaps of the backstrip to the paste down sheet of the endpapers, while the spine of the cover is spaced from the binding edge of the book block. Books of this type have a consistent value, given by the hardcover and are also resistant to the use also for threadless text block. On the other hand, the binding plants which carry out hardcover books are complex and need several specialized machines and/or long working times. Further, specialized personnel are necessary, mainly when books of different dimensions and/or characteristics should be bound.

The paperback books have a cover of flexible cardboard, with a spine directly glued to the binding edge of a text block, which can be bound by high productivity binders and, therefore, with inherent low costs. For these reasons, the paperback books are generally included in so-called "economic" collections. The binding plants which produce such types of books can be further programmed for carrying out bindings on books of different dimensions and, "books on demand", allowing low cost production of books in limited quantity.

An equipment for binding paperback books of the type above defined has been disclosed in the Italian patent application TO2009A000477, filed on Jun. 23, 2009, in the name of the applicant Tecnau S.r.l. and of ROTOMAIL Italy S.p.A. and having, as counterpart, the European patent application EP 2 269 823.

As a matter of fact, the market accepts that, under the same contents, paper quality and printing, hardcover books can be sold at prices higher than the ones of paperback books. Nevertheless, the difference between the sale prices results meaningfully greater than the difference of costs given only to the costs of the materials used in the two typologies of books.

SUMMARY OF THE INVENTION

An object of the invention is to carry out a binding plant for hardcover books and a method of binding for such books, which have costs of production similar to the ones for the productions of flexible cover books.

According to this object, the binding plant for hardcover books of the invention comprises a binding equipment having a block input (IB) for receiving text blocks and a cover input (IC) for receiving covers; a book information detecting or setting device, for obtaining book data on the thickness of the text block to be bound; a false cover forming equipment for receiving and reciprocally positioning backstrips and pairs of endpapers and carrying out false covers; and an electronic processing unit for controlling the binding equipment and the false cover forming equipment as a function of said book data. Each false cover is defined by a pair endpapers and a backstrip, wherein the pair of endpapers are sided to a central portion of the backstrip with the paste down sheets of the endpapers glued to the lateral flaps of the backstrip. The false cover forming equipment is controlled by the electronic processing unit in response to the book data for arranging the folds of the endpapers at a pre-assembling distance associated with the thickness (TL) of the text block and gluing the margins of the paste down sheet close to the winding with the flaps of the backstrips, and the binding equipment is feedable, at the block input (IB), with the text blocks and, at the cover input (IC), with the false covers. The binding equipment is controlled by the electronic processing unit for forming the book blocks, by gluing the central portion of the backstrip of an entered false cover with a binding edge of an entered text block and refolding on the entered text block the pair of endpapers, together with the lateral flaps of the backstrip glued to the paste down sheets.

The method of binding for hardcover books provides a binding plant including: a binding equipment having a block input (IB) for receiving text blocks and a cover input (IC) for receiving covers; a book information detecting or setting device, 60 for obtaining book data on the thickness of the text block to be bound; a false cover forming equipment for receiving and reciprocally positioning the backstrips and pairs of endpapers and carrying out respective false covers; and an electronic processing unit for controlling the binding equipment and the false cover forming equipment as a function of said book data. In particular the method comprises the following steps:

a) feeding the false cover forming equipment with a backstrip having a width consisting with the thickness (TL) of the text block and the width of the lateral flaps, and a pair of endpapers;

b) actuating the false cover forming equipment in response to the book data for arranging the folds of the endpapers at a pre-assembling distance associated with the thickness (TL) of the text block and gluing the margins of the paste down sheet close to the winding with the flaps of the backstrip;

c) feeding the binding equipment, through the block input (IB) and the cover input (IC), with the text blocks and respective false covers; and d) actuating the binding equipment for the formation of the book block under the control of the electronic processing unit for forming the book blocks, by gluing the central portion of the backstrip of an entered false cover with the binding edge of an entered text block and refolding on the text block the pair of endpapers, together with the lateral flaps of the backstrip glued to the paste down sheet.

The characteristics of the invention will become clear from the following description given purely by way of non-limiting example, with reference to the appended drawings in which:

DESCRIPTION OF THE PREFERRED EMBODIMENTS

Figure 1:
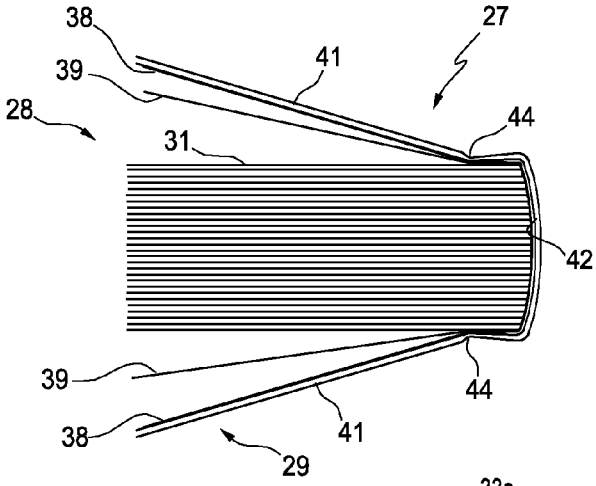
FIG. 1 represents is a schematic view of a hardcover book.
Figure 2:
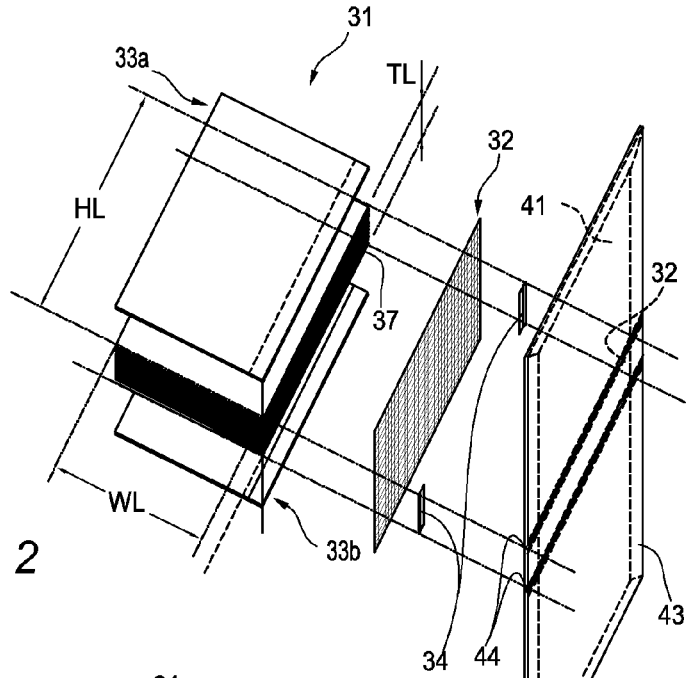
FIG. 2 shows schematically an exploded view of the book represented in FIG. 1.
Figure 3:
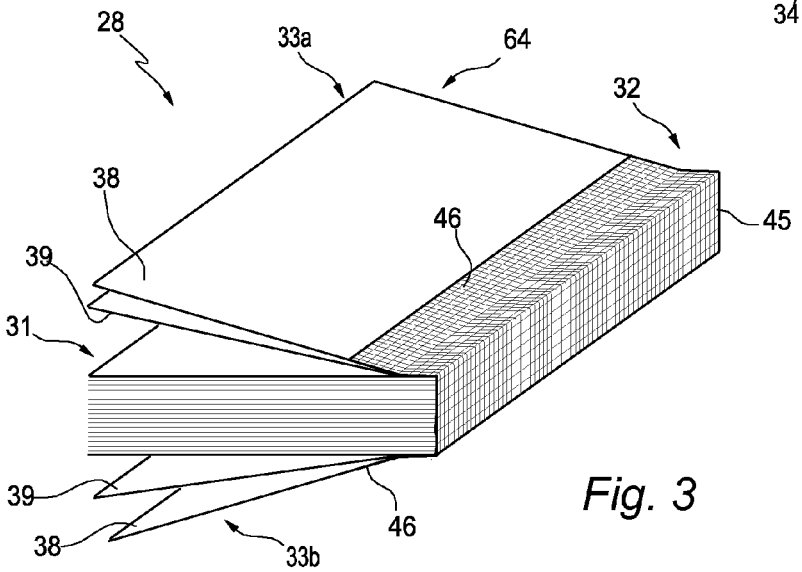
FIG. 3 is a component of the book of FIG. 1 in a given step of binding of the book.

With reference to the FIGS. 1, 2 and 3, a typically hardcover book having a book block 28 and a hardcover 29 is represented with 27. The book block 28 includes a text block 31, an edge backstrip or book muslin 32 and a pair of endpapers 33*a*, 33*b*. The hardcover book 27 can also provide headbands 34 at the base and the head of the book block 28.

The text block 31 is formed as paperback binding and presents a binding edge 37 for a binding adhesive. The backstrip 32 is of gauze, muslin, or cloth or other material deeply glued with the binding edge 37 to ensure a firm connection between text block and cover and gives shape and firmness to the binding. Each endpaper 33*a*, 33*b* is constituted by a once-folded sheet having a free sheet 38, a paste down sheet 39 and a fold 40 and in which the free sheet 38 is overlapped to the text block 31, while the paste down sheet 39 is pasted against the front or back cover of the hardcover book 27. The hardcover 29 includes two cover boards 41, a spine 42 and a covering 43 for the boards 41 and the spine 42. The covering 43 is of paper or other suitable flexible material and presents depressed joints 44 between the boards 41 and the spine 42, which represent hinges when the boards open.

The backstrip 32 has a central portion 45 for the text block 31 and two lateral binding flaps 46 for the cover boards 41. Binding the book 27 is ensured through gluing the central portion 45 of the backstrip 32 to the binding edge 37 of the text block 31 and gluing the sheets 39 and the flaps 46 to the cover boards 41. Thus, the binding flaps 46 result interposed between the boards 41 close to the joints 44 and the sheets 39 close to the respective fold 40. Besides, the free sheets 38 of the endpapers 33*a*, 33*b* have the respective margins, close to the fold, glued to corresponding margins of the first sheet and the last sheet of the text block 31 close to the binding edge 37. In turn, the joints 44 allow the cover boards 41 to move freely in opening and closing of the book 27.

Figure 4:
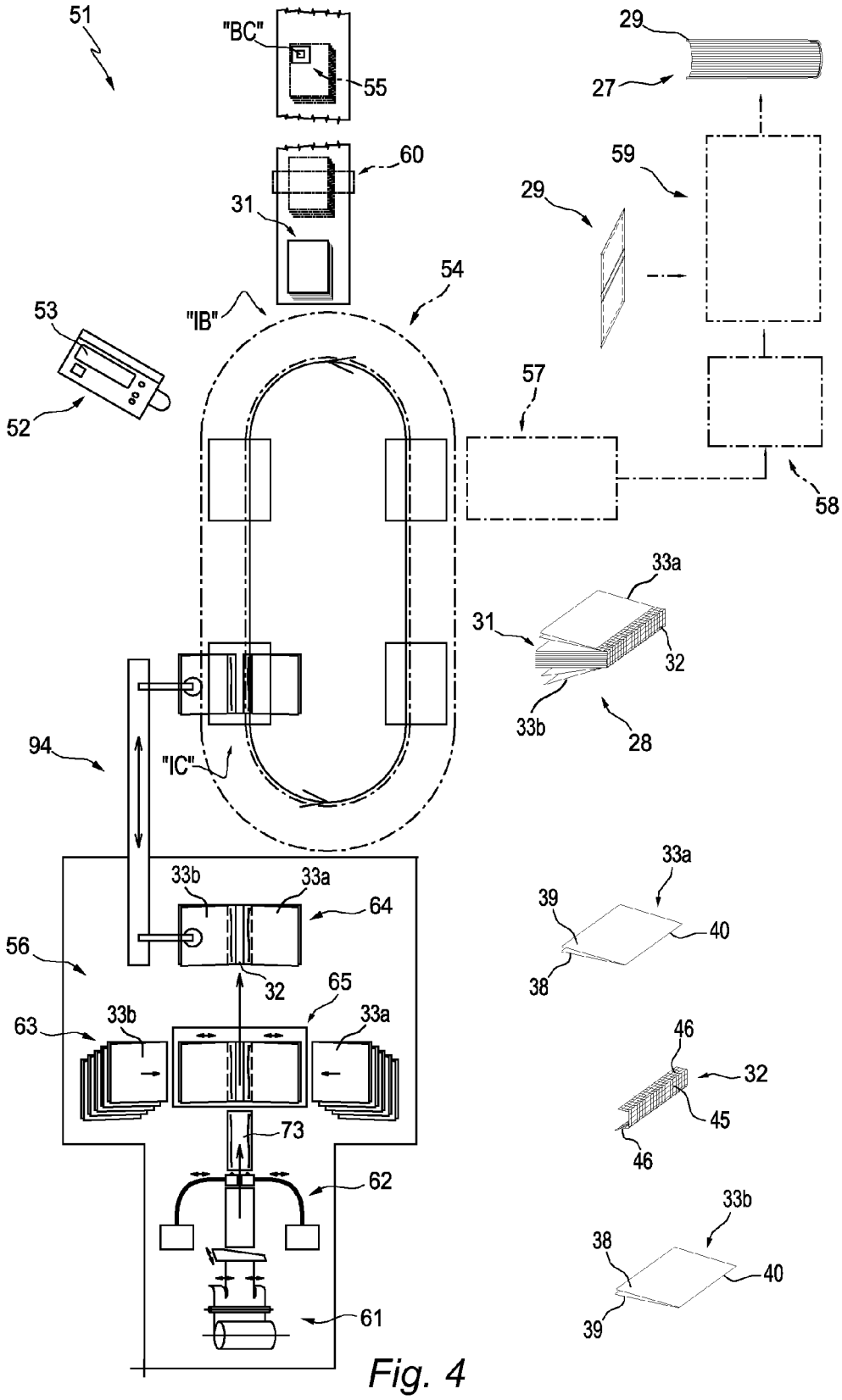
FIG. 4 shows a schematic plan view of a binding plant for hardcover books according to the invention.

A binding plant for hardcover books according to the present invention has been represented with 51 in FIG. 4. For manufacturing the book blocks 28, the plant 51 includes a control station 52 with a console accessible by operator, an electronic processing unit 53, a binding equipment 54 and a false cover forming equipment 56.

For completing the binding of hardcover books, the plant 51 further comprises assembling and finishing equipments, including a trilateral cutting equipment 57, a book back rounding equipment 58 and a casing equipment 59. The trilateral cutting equipment 57 provides the cutting of three sides of the book blocks 28; the book back rounding equipment 58 achieves rounding the binding edge of the book blocks 28, while the casing equipment 59 provides the casing in of the book 27 by gluing the book blocks 28 with the covers 29. The plant 51 further includes drying stations arranged between the various equipments. These components, go beyond the ambit of the present invention, can be of known type, and are here not described.

The binding plant 51 can produce books of different dimensions on the basis of book information from detecting or setting device. In particular, the width "WL", the height "HL" and the thickness "TL" of the book block 28 can be included in coded information "BC" printed on the text block 31 and read by a reading unit 55. In addition or in alternative, book data regarding the thickness "TL" of the text block 31 can be obtained from on-line measurement of a thickness measurement station 60, and/or entered through manual setting-up of the control station 52. In detail, the control of the binding plant 51 can be of the type provided for assembling books "on-demand", as described in the above mentioned patent applications TO2009A000476 or EP 2 269 823, and herein incorporated for references. Of course, some of the controls for the devices and the equipments of the plant 51 can be made by local electronic control units.

The binding equipment 54 (FIG. 4) is substantially of known type, as provided for the binding of paperback book. In particular, the binding equipment 54 presents an input "IB" for the input of the text blocks 31 and an input "IC" for the input of covers to be bound with the text blocks 31.

Figure 5:
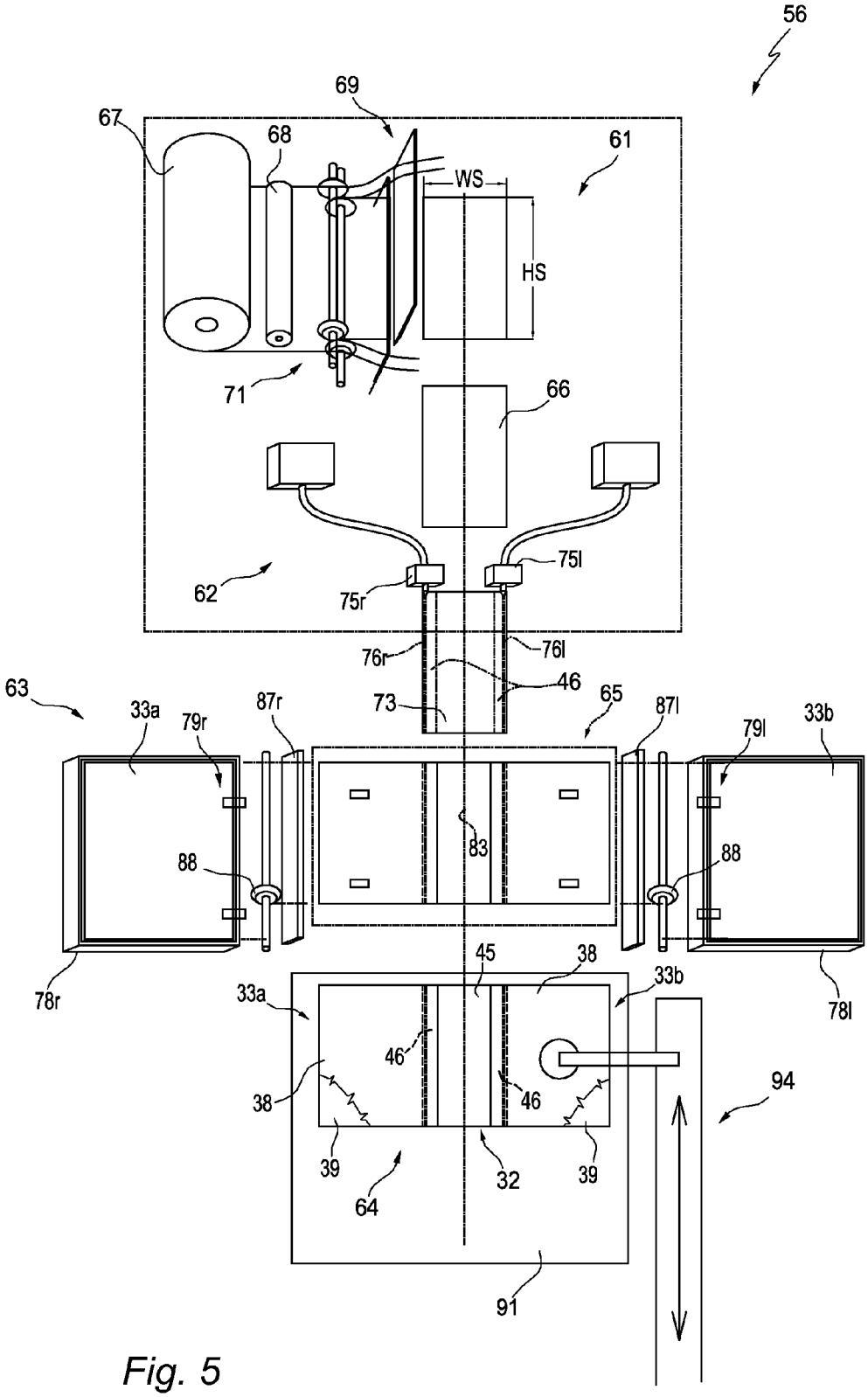
FIG. 5 is a schematic plan view of some components of the binding plant according to the invention.
Figures 6A, 6B, 6C, 6D:
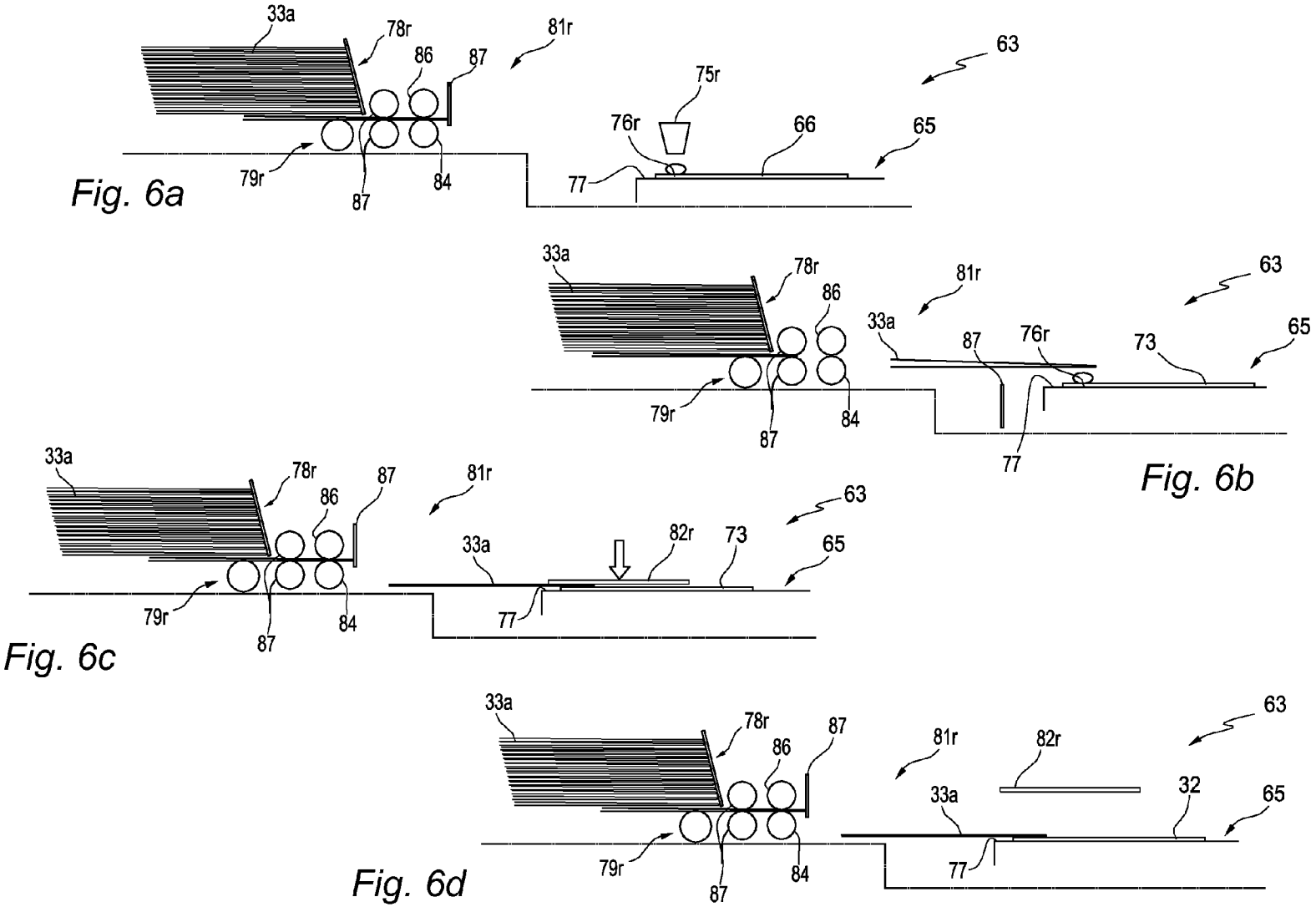
FIGS. 6*a*-6*d* represent diagrams of some components of FIG. 5 in different operative conditions.

According to the invention, the false cover forming equipment 56 (FIGS. 4 and 5) comprises a strip feeding and cutting device 61, a pre-gluing device 62 and an endpaper feeding and assembling device 63 with an assembling station 65.

The false cover forming equipment 56 carries out false covers 64 formed by two endpapers 33*a*, 33*b* and a backstrip 32 in a substantially flat configuration. In detail, the central portion 45 of the backstrip 32 is free and is sided by the endpapers 33*a*, 33*b*, while the lateral flaps 46 are glued to the margins of the paste down sheets 39 close to the folds 40. The distance of the folds 40 is of few greater than the thickness "TL" of the text blocks 31, while the free sheets 38 of the endpapers 33*a*, 33*b* are overlapped to the paste down sheets 39.

The binding equipment 54 can be fed through the cover input "IC" with the false covers 64, for carrying out the book blocks 28 by gluing the central portion 45 of the backstrips 32 with the binding edge 37 of corresponding text blocks 31 and refolding the pairs of endpapers 33*a*, 33*b* on the respective text blocks. On instructions from a program and data from the "BC" codes of the book block, and/or data entered through the control station 52 and/or the thickness measurement device 60 the electronic processing unit 53 provides to control the false cover forming equipment 56 and the binding equipment 54 as a function of the dimensions of the book 28 to be bound.

The strip feeding and cutting device 61 (FIG. 5) produces, for each text block, a pre-shaped backstrip 66, having a width "WS" congruent with the thickness of the text block "TL" and the width of the binding flaps 46. In a preferred embodiment of FIG. 5, the backstrips 66 are obtained from a muslin strip 67 wound in spool in the sense of the width and are unwound by an unwinding mechanism 68. The strips are cut by a cutting mechanism 69 and a trimming mechanism 71: The cutting mechanism 69 cuts the strip 67 unwinding from the spool transversally to the whished width "WS" for the pre-shaped backstrip. In turn, the trimming mechanism 71 trims the margins of the strip 67 up to the whished length "HS."

In the variant of FIG. 4, a muslin strip of origin for the pre-shaped backstrip is wound as spool in the sense of the longitudinal axis of the whished backstrip. A transversal separation mechanism cuts the unwinding strip to the length "HS", while a trimming mechanism trims the margins of the strip to the width "WS."

The pre-gluing device 62 spreads a layer of adhesive, on a portion of the binding flaps 46 of the pre-shaped backstrip 66, whereby forming a pre-glued backstrip 73. In detail, the device 62 (FIG. 5) comprises two glue spreading elements 75*l* and 75*r* controlled by the control unit 53. The spreading elements 75*l* and 75*r* are shiftable transversally to the pre-shaped strip 66 at a reciprocal distance greater than the thickness of the text block 31 and spread a thread of adhesive on gluing tracks 76*l* and 76*r* of the pre-shaped backstrip 66. Then, a feeding mechanism, not shown in the drawings, moves the pre-glued strip 73 to the assembling station 65 of the endpaper feeding and assembling device 63 along a direction parallel to a longitudinal axis of the pre-glued backstrip 73.

In detail, the endpaper assembling station 65 comprises a working plane 77 substantially horizontal of support for the pre-glued strip 73 and the endpaper 33*a* and 33*b* during the positioning and the assembling of the false cover 64. The endpaper feeding and assembling device 63 is provided for positioning the pair of endpapers 33*a*, 33*b* in correspondence of the binding flaps 46 of a respective pre-glued backstrip 73 arranged on the plane 77 and gluing the endpapers 33*a*, 33*b* to the flaps 46 of the pre-glued strip.

The endpaper feeding and assembling device 63 includes two stores 78*l* and 78*r* for storing two stacks of endpapers 33*a* and 33*b*, two separating devices 79*l* and 79*r*, two endpaper positioning devices 81*l* and 81*r* and pressing elements 82*l* and 82*r*. These components are arranged symmetrically at the sides of the assembling station 65. Further, the endpapers 33*a*, 33*b* in the stacks are symmetrical with respect to a reference geometrical surface 83 perpendicular to the working plane 77 of the station 65 and passing through the direction of movement of the pre-glued backstrip 73. The folds 40 of the endpapers 33*a* and 33*b* are faced toward the surface 83, while the separating devices 79*l* and 79*r* separate the endpapers with starting of movement of the folds 40 toward the reference surface 83.

In the FIGS. 6*a*-6*d*, the components of the endpaper feeding and assembling device 63 have been represented in their operation, arranged at a sole side of the station 65. In view of the symmetry, the components arranged at the other side of the station 65 have not been shown.

The endpaper positioning devices 81*l* and 81*r* position the endpapers 33*a* and 33*b* with the folds 40 at a reciprocal pre-assembling distance associated to the thickness "TL" of the text block 31. For instance, the positioning devices 81*l* and 81*r* include respective moving mechanisms, each one including an advancing motor roller 84, a pinch roller 86 and a contrast wall or suitable contrast element 87. The advancing motor rollers 84, and the pinch rollers 86 are arranged symmetrically at the sides of the assembling station 65, parallel to the reference surface 83 and a little above the working plane 77. The rollers 84 and 86 and the contrast wall or element 87 can be configured and are actuatable between an operative condition and a non-operative condition on control of the processing unit 53. The contrast walls or element 87 ensure a precise reference and lined up position for the endpapers 33*a* and 33*b*, preliminarily to the final position of the endpapers 33*a* and 33*b* for the gluing to the pre-glued backstrip 73.

In the operative condition, the contrast walls or elements 87 (FIG. 6*a*) are at a predetermined distance from the reference surface 83, while the rollers 84 and 86 move the respective endpapers 33*a* and 33*b* up to the stop against the contrast walls or elements 87. In the non-operative condition, the contrast walls or elements 87 (FIG. 6*b*) are removed, while the rollers 84 and 86 move the endpapers 33*a* and 33*b*, in a controlled way, above the pre-glued backstrip 73, up to the position associated to the respective pre-assembling distance.

The pressing elements 82*l* and 82*r* (FIG. 6*c*) are now activated for gluing the endpapers 33*a*, 33*b* with the pre-glued backstrip 73, by effecting a gluing pressure between the margins of the endpapers and the gluing tracks 76*l* and 76*r* against the working plane 77, whereby forming the false cover 64. The pressing elements 82*l* and 82*r* (FIG. 6*d*) are finally removed for allowing the moving of the false cover 64.

Conveniently, the stores 78*l* and 78*r* can stack endpapers of standard dimensions, adapted for books of larger dimensions. In this case, cutting mechanisms, for instance having rotary blades 88, are provided, arranged downstream of the separating devices 79*l* and 79*r*. These cutting devices are such to cut the endpapers at a height substantially equal to the height of the text blocks 31. After forming the book block 28, the excess of the endpapers in the sense of the width of the false cover 64 will be rectified by the trilateral cutting equipment 57, jointly with the cutting of the other sheets of the book block.

Moving members, not shown in the drawings, move the false covers 64 from the assembling station 65 to a cover switching station 91. The station 91 is substantially at the same level of the cover input "IC" of the binding equipment 54 and includes alignment contrasts 92 and 93 for arranging the false cover 64 in a precise position with respect to the cover input "IC". From here, a transfer device 94, for instance a sucker device, is actuatable on control of the control unit 53 for transferring the false covers to the cover input of the binding equipment 54.

The binding equipment 54 executes the binding of a book block 28 by gluing the backstrip 32 of the false cover 64 with the binding edge 37 of the corresponding text block 31, preferably extending the adhesive on the margins of the first and the last sheet of the text block, and refolding the pairs of endpapers 33*a* and 33*b* with the glued lateral flaps 46 on the respective text block 31. It ensures that the folds 40 of the endpapers are of few spaced away from the binding edge 37, with the margins of the free sheets 38 glued to the corresponding margins of the first and the last sheet of the text block 31, according to the best technique of binding.

For obtaining the hardcover book 27, the book block 28 is subject to cutting, possible rounding of the binding edge 37 and sticking of the headbands 34. Thereafter, the book block 28 is cased in with the hard cover 29. These operations are fulfilled in usual way by means of the trilateral cutting equipment 57, the book back rounding equipment 58 and the casing equipment 59.

Figure 7:
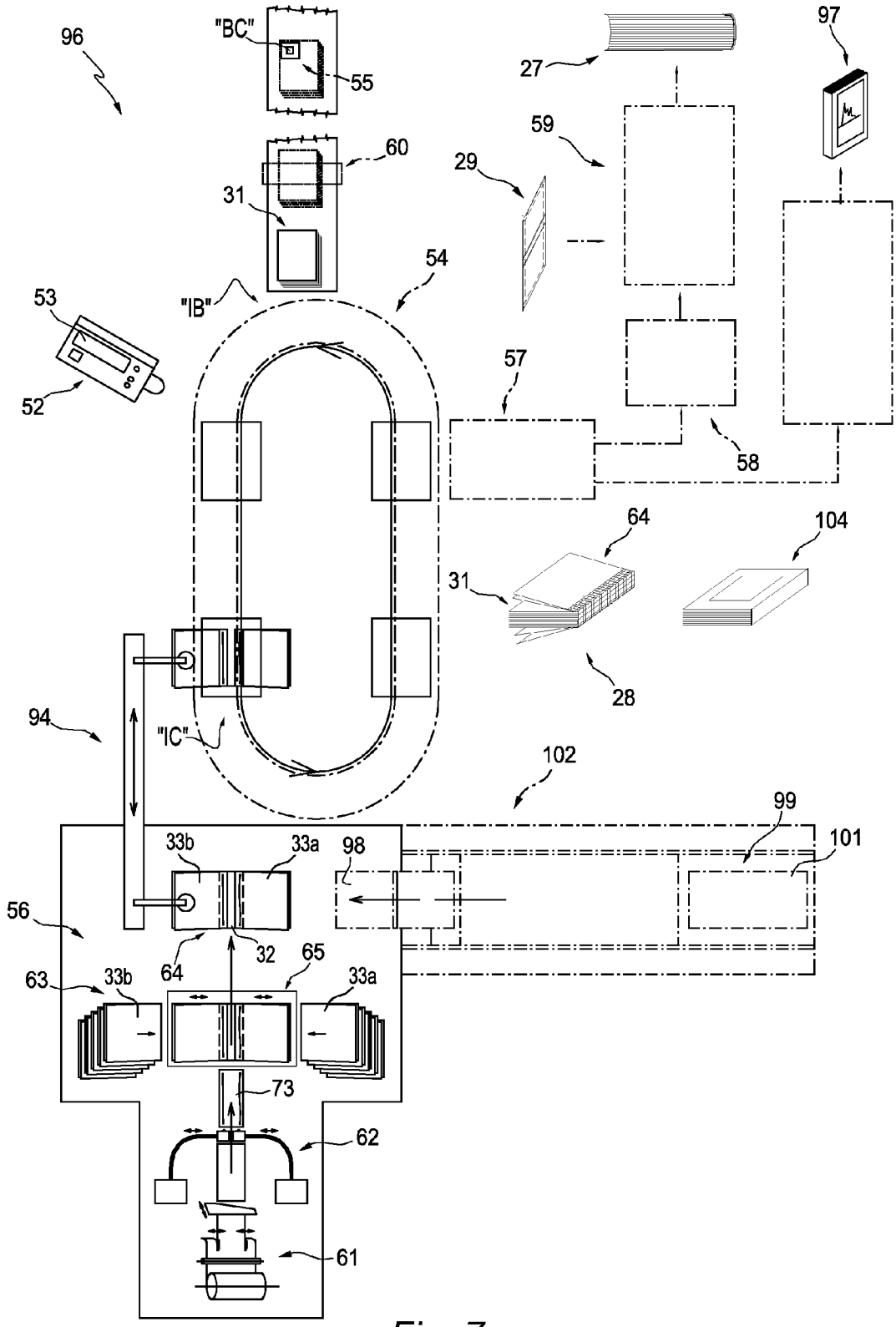
FIG. 7 shows a schematic plan view of another binding plant for hardcover books according to the invention.

Conveniently, the binding plant of the invention, represented with 96 in FIG. 7, can process also paperback books 97 with flexible covers 98. The general structure of the plant 96 is similar to the one of the plant 51 of FIG. 4 and in which the components having identical function have been represented with same reference numerals. The differences regarding the plant 96 concern the fact that a store 99 for flexible cover sheets 101 and a cover input and forming mechanism 102 are also provided. The mechanism 102 carries out preformed cover 103, which can be moved into the switching station 91. An example of structures regarding the formation of flexible covers has been described in the cited patent applications N. TO2009A000478 and EP 2 269 823.

In the plant 96, the nipping and transferring device 94 or another nipping and transferring device is actuatable for with-drawing, in alternative, the pre-formed cover 103 and transferring it to the cover input "IC" of the binding equipment 54. Suitably, in alternative to the binding of hardcover books the binding equipment 54 can be set up for carrying out pre-finished paperback books 104 by gluing the binding edge of corresponding text blocks 31 with an opposite portion of the spine of the respective preformed covers 103.

Figure 8:
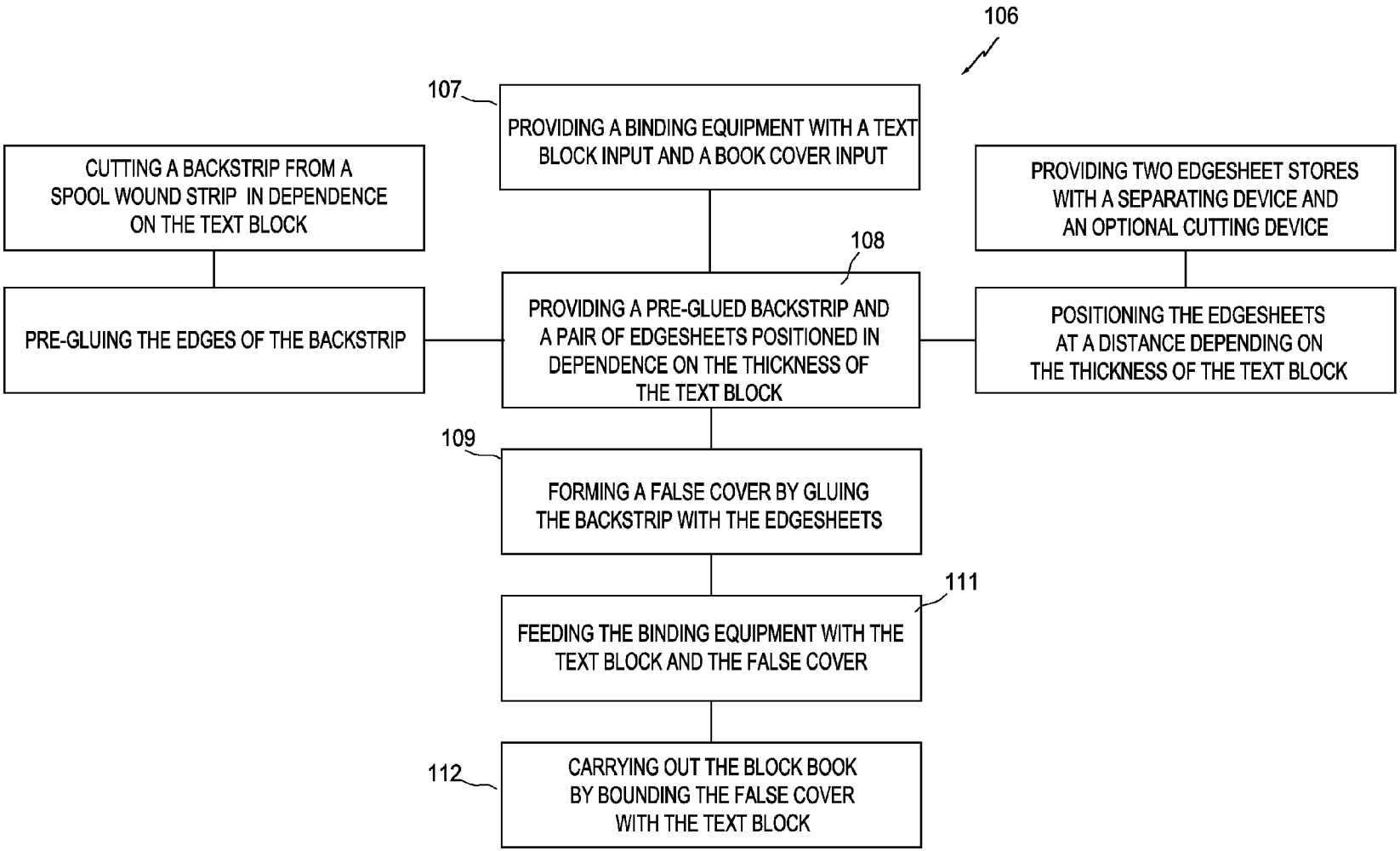
FIG. 8 is a block diagram representative of the method of binding for hardcover books according to the invention.

From the above description, it should be clear that the plant 51, 96 follows a method of binding for hardcover books, represented with 106 (FIGS. 7 and 8), which uses text blocks 31, edge backstrips 32 for the binding edges of the text blocks 31 and endpapers 33*a* and 33*b* for the text blocks and formation of book blocks 28 pre-set for the assembling with respective hardcovers 29. The method 106 provides a binding equipment 54 including a block input "IB" for the text blocks 31 and a cover input "IC" for covers of the text blocks (block 107) and comprises the followings steps:

a) providing (block 108), a backstrip 73 and a pair of endpapers 33*a* and 33*b*, positioned in dependence on the thickness of the text block;
b) gluing the backstrip 32 (block 109) to the endpapers, whereby carrying out a false cover 64;
c) feeding the binding equipment 54 (block 111) with the text blocks 31 and the false covers 64; and
d) carrying out the book blocks 28 (block 112) by gluing the backstrips of the false covers with the binding edge of corresponding text blocks.

Naturally, the principle of the invention remaining the same, the embodiments and the details of construction can broadly be varied with respect to what has been described and illustrated, by way of non-limitative example, without by this departing from the ambit of the present invention.

For instance, positioning and alignment walls or similar elements, not shown in the figures, can be provided, in alternative to the contrast walls or elements 87. The positioning and alignment walls or elements are arranged at the pre-assembling distance in correspondence with the gluing tracks 76*l*, 76*r* of a pre-glued backstrip 73 on the working plane 77. These positioning and alignment walls or elements are provided for being positioned between an operative position of a little above the pre-glued backstrip 73 and a non-operative position. After the unstacking and in the operative position of the positioning and alignment walls or elements, the feed and pressure rollers 84 and 86 move the endpapers 33*a* and 33*b* above the backstrip 73. It occurs up to their arrest against the positioning and alignment walls or elements, with consequent positioning of the folds 40 at the respective pre-assembling distance. In the non-operative position, the positioning and alignment walls or elements are spaced away from the backstrip 73, and allow the activation of the pressing elements 82*l* and 82*r* for gluing the endpapers 33*a*, 33*b* with the strip 73.

Even more in general, in a variant of the endpaper feeding and assembling device, not shown in the drawings, the endpapers 33*a* and 33*b* can be obtained from paper strips wound on two spools arranged at the sides of the assembling station 65. This variant includes unwinding and cutting mechanisms and a folding mechanism arranged at the sides of the assembling station 65 and also controlled by the processing unit 53. After unwinding, the paper strips are cut and/or trimmed according to the dimensions of the text block and folded by superimposing the paste down sheet with the free sheet. Then, the endpapers 33*aa* and 33*b* are directed to position the folds 40 parallel to the axis of the assembling station and subsequently positioned, as described for the endpaper positioning devices 81*l* and 81*r*.

In the case in which the binding plant of the invention can also process the paperbooks 97 with the flexible covers 98, in alternative to the cover store 99 and the cover input and forming mechanism 102, different feeding and forming mechanisms can be provided. Specifically, the preformed flexible cover 103 can be obtained from a paper strip wound in spool, conveniently cut, trimmed and ribbed as a function of the dimensions of the text block.

What is claimed is:

1. A binding plant for hardcover books, wherein each hardcover book is of a type including a hardcover having a pair of cover boards and a book block having a text block of a given thickness (TL), a backstrip (muslin) with a central portion and lateral binding flaps and a pair of endpapers with a free sheet, a paste down sheet and a respective fold, wherein, said book block is provided for being assembled with said hardcover by gluing backs of the cover boards with the lateral binding flaps of the backstrip and the paste down sheets of the endpapers, and wherein for formation of the book block, said binding plant comprises:

a binding equipment having a block input (IB) for receiving the text block and a cover input (IC) for receiving a cover to be bound with the text block;

a book information detecting or setting device, for obtaining book data on the thickness of a text block to be bound;

a false cover forming equipment for receiving, reciprocally positioning and gluing the backstrip and the pair of endpapers and carrying out a false cover;

an electronic processing unit for controlling the binding equipment and the false cover forming equipment as a function of said book data; wherein:

each said false cover is defined by pair of endpapers sided to the central portion of the backstrip with margins of the paste down sheets close to the fold and glued to the lateral flaps of the backstrip;

the fold of the endpapers at a pre-assembling distance associated with the thickness (TL) of the text block and gluing the margins of the paste down sheets of the endpapers with the flaps of the backstrips; and the binding equipment is feedable, at the block input (IB), with the text block and, at the cover input (IC), with said false cover as the cover to be bound with the text block; and wherein the binding equipment is controlled by the electronic processing unit for forming the book blocks, by gluing the central portion of the backstrip of said false cover with a binding edge of the text block and refolding on the text block the pair of endpapers, together with the lateral flaps of the backstrip glued to the margins of the paste down sheets.

2. The binding plant according to claim 1 wherein the pre-assembling distance is of a few greater with respect to the thickness (TL) of the text block, and wherein the binding equipment carries out the book block by extending the gluing of the false cover to the margins of a first sheet and a last sheet of the text blocks, close to the binding edge of said text block.

3. The binding plant according to claim 1, wherein said backstrip is obtained as a pre shaped backstrip from a strip wound on a backstrip spool, while the binding plant further comprises a strip feeding and cutting device, and wherein the strip feeding and cutting device includes an unwinding mechanisms for the backstrip spool and cutting and/or trimming mechanisms for unwinding the strip and cutting and/or trimming an unwinding strip for dimensioning the pre-shaped backstrip according to a height (HL) and the thickness (TL) of a text block to be bound and a width of the lateral flaps of the backstrip.

4. The binding plant according to claim 1 further comprising a strip feeding and cutting device and a pre-gluing device, wherein the strip feeding and cutting device is provided for carrying out pre-shaped backstrip dimensioned according to a height (HL) and the thickness (TL) of a text block to be bound, and a width of the lateral flaps of the backstrip, while the pre-gluing device is provided for spreading a layer of glue, as gluing tracks, on the lateral flaps of the pre-shaped backstrip and forming a pre-glued backstrip, and wherein the false cover forming equipment includes pressing elements, said pressing elements being actuatable for determining a gluing pressure between the endpapers and the pre-glued backstrip.

5. A binding plant for hardcover books, wherein each hardcover book is the type including a hardcover having a pair of cover boards and a book block having a text block of given thickness (TL), a backstrip (muslin) with a central portion defining a longitudinal axis and lateral binding flaps and a pair of endpapers with a free sheet, a paste down sheet and a respective fold, wherein, for formation of books blocks, and binding plant comprises:

a binding equipment having a block input (IB) for receiving a text block and a cover input (IC) for receiving a cover;

a book information detecting or setting device, for obtaining book data on the thickness of a text block to be bound;

a false cover forming equipment for receiving and reciprocally positioning a backstrip and a pair of endpapers and carrying out a false cover;

an electronic processing unit for controlling the binding equipment and the false cover forming equipment as a function of said book data; wherein:

said false cover is defined by the pair endpapers sided to the central portion of the backstrip with margins of the paste down sheets close to the fold and glued to the lateral flaps of the backstrip;

the false cover forming equipment is controlled by the electronic processing unit in response to the book data for arranging the folds of the endpapers at a pre-assembling distance associated with the thickness (TL) of the text block and gluing respective margins of the paste down sheets of the endpapers close to the fold with the flaps of the backstrips;

the binding equipment is feedable, at the block input (IB), with the text blocks and, at the cover input (IC), with the false covers as said cover to be bound with the text block; and the binding equipment is controlled b the electronic processing unit for forming the book blocks, by gluing the central portion of the backstrip of said false cover with a binding edge of the text block and refolding on the text block the pair of endpapers, together with the lateral flaps of the backstrip glued to the paste down sheets, wherein the false cover forming equipment comprises an assembling station and an endpaper feeding and assembling device wherein the assembling station includes a working plane of support for a backstrip and a pair of endpapers to be assembled and defines a reference surface perpendicular to said working plane and passing through a longitudinal axis of a backstrip supported by said working plane, the endpaper feeding and assembling device is provided for moving a pair of endpapers up to the working plane of the assembling station with the folds at said pre-assembling distance, and gluing with the backstrip, and said endpaper feeding and assembling device operates at the sides of said working plane with arrangement of the folds symmetrical with respect to said reference surface.

6. The binding plant according to claim 5, wherein the endpaper feeding and assembling device comprises two stores at the sides of the assembling station for lodging two stacks of endpapers, two separating devices and two endpaper positioning devices, wherein the separating devices are actuatable for separating the endpapers from said stack, and wherein the endpaper positioning devices are actuatable for moving separated endpapers toward said reference surface.

7. The binding plant according to claim 5, wherein the endpaper feeding and assembling device includes two endpaper positioning devices, wherein said two endpaper positioning devices include two moving mechanism for the endpapers and a pair of contrast and alignment elements, and wherein said contrast and alignment elements are provided for being positioned between an operative configuration, at a predetermined distance from the reference surface and a non-operative configuration, while each moving mechanism, in the operative configuration of the contrast and alignment element, moves a respective endpaper up to a position of alignment against the contrast and alignment element and, in the non-operative configuration of the contrast and alignment element, moves the respective endpaper, in controlled way, up to the respective pre-defined position.

8. The binding plant according to claim 5, wherein the false cover forming equipment stores endpapers of standard large dimensions and further providing two cutting devices, upstream of the assembling station, for conforming a height of the endpapers to the height (HL) of the text block.

9. The binding plant according to claim 5, wherein the assembling station receives on the working plane pre-glued backstrips, each one having gluing tracks on respective lateral flaps, wherein the endpaper feeding and assembling device includes positioning and alignment elements arranged at the pre-assembling distance in correspondence of the gluing tracks of a pre-glued backstrip arranged on the working plane and wherein the positioning and alignment elements are positionable between an operative position of a little above the pre-glued backstrip arranged on the working plane and a non-operative position, in the operative position of the positioning and alignment elements, the endpaper feeding and assembling device feeding the endpapers above the pre-glued backstrip up to arrest against the positioning and alignment elements with consequent positioning of the folds at the respective pre-assembling distance, whilst, in the inoperative position of the positioning and alignment elements, the pressing elements are actuatable for gluing the endpapers with the pre-glued backstrip against said working plane.

10. The binding plant according to claim 5, wherein the endpapers are obtained from continuous paper strips, wherein said endpaper feeding and assembling device comprises a pair of spools for the paper strips, unwinding and cutting mechanisms actuatable for unwinding the pair of spools and cutting unwind strip and folding mechanisms actuatable for folding cut strips from the unwinding and cutting mechanisms, and wherein the unwinding and cutting mechanisms and the folding mechanisms are arranged at the sides of the assembling station, and wherein the paper strips are cut and/or trimmed by the unwinding and cutting mechanisms for forming contiguously the free sheet and the paste down sheet according to the dimensions of the text block, while the folding mechanisms are actuatable for carrying out the endpapers by folding and superimposing the paste down sheets and the free sheets.

11. The binding plant according to claim 1, wherein the false covers are formed or are positioned on pre-defined positions of a cover switching station and wherein a nipping and transferring device is provided for taking and moving the false covers from the cover switching station to the cover input (IC) of the binding equipment.

12. The binding plant according to claim 11, wherein said binding plant can manufacture paperback books having flexible covers and includes a device for the pre-formation of the flexible covers, and wherein a nipping and transferring device or nipping and transferring devices are provided for taking, in alternative, the flexible cover and transferring the flexible cover to the cover input (IC) of the binding equipment, while said binding equipment is correspondingly set up for carrying out each paperback book by gluing the binding edge of a corresponding text block with an opposite portion of a spine on a respective flexible cover.

13. A false cover forming equipment, for receiving and reciprocally positioning backstrips and pairs of endpapers for text books and carrying out false covers to be used in a binding plant for hardcover books;

wherein each backstrip has a central portion for gluing with a binding edge of the text book and lateral flaps while each endpaper has a free sheet, a paste down sheet and a respective fold between the free sheet and the paste down sheet;

wherein each false cover is defined by a pair of endpapers and a backstrip, wherein the pair of endpapers are sided to a central portion of the backstrip with the paste down sheets of the endpapers glued to the lateral flaps of the backstrip; and wherein said false cover forming equipment is provided for arranging the folds of the endpapers at a pre-assembling distance associated with a thickness (TL) of the text block and gluing margins of the paste down sheet close to the winding with the lateral flaps of the backstrips;

said false cover forming equipment comprising:

an assembling station and an endpaper feeding and assembling device wherein the assembling station includes a working plane of support for a backstrip and a pair of endpapers to be assembled and defines a reference surface perpendicular to said working plane and passing through a longitudinal axis of a backstrip supported by said working plane, and wherein the endpaper feeding and assembling device is provided for moving a pair of endpapers up to the working plane of said assembling station with the folds at said pre-assembling distance and assembling with a respective backstrips, said endpaper feeding and assembling device operating at the sides of the assembling station with arrangement of the folds symmetrical with respect to the reference surface.

14. The false cover forming equipment according to claim 13, wherein the endpaper feeding and assembling device includes two stores and two separating devices at the sides of the assembling station, wherein the separating devices lodge two stacks of endpapers and the separating devices are provided for separating the endpapers from said stack with starting movement of separated endpapers toward said reference surface.

* * * * *